US005350967A

United States Patent [19]

Chen

[11] Patent Number: 5,350,967

[45] Date of Patent: Sep. 27, 1994

[54] INLINE ELECTRON GUN WITH NEGATIVE ASTIGMATISM BEAM FORMING AND DYNAMIC QUADRUPOLE MAIN LENS

[75] Inventor: Hsing-Yao Chen, Barrington, Ill.

[73] Assignee: Chunghwa Picture Tubes, Ltd., Taoyuan, Taiwan

[21] Appl. No.: 783,196

[22] Filed: Oct. 28, 1991

[51] Int. Cl.[5] ..... H01J 29/58

[52] U.S. Cl. ..... 313/413; 313/414; 313/412; 313/439; 313/449; 315/368.27

[58] Field of Search ..... 313/412, 413, 414, 425, 313/528, 432, 439, 440, 452, 449; 315/382, 15, 16, 368.15, 368.24, 368.27

[56] References Cited

U.S. PATENT DOCUMENTS

| | | | |
|---|---|---|---|
| 3,952,224 | 4/1976 | Evans, Jr. | 313/414 |
| 4,234,814 | 11/1980 | Chen et al. | 313/412 |
| 4,242,613 | 12/1980 | Brambring et al. | 313/447 |
| 4,319,163 | 3/1982 | Chen | 315/14 |
| 4,366,414 | 12/1982 | Hatayama et al. | 313/409 |
| 4,473,775 | 9/1984 | Hosokoshi et al. | 315/14 |
| 4,523,123 | 6/1985 | Chen | 313/412 |
| 4,628,224 | 12/1986 | Collins et al. | 313/414 |
| 4,629,933 | 12/1986 | Bijma et al. | 313/414 |
| 4,641,058 | 2/1987 | Koshigoe et al. | 313/449 |
| 4,701,677 | 10/1987 | Ashizaki et al. | 315/382 |
| 4,825,120 | 4/1989 | Takahashi | 313/414 |
| 4,831,309 | 5/1989 | Ashizaki et al. | 313/413 |
| 4,886,998 | 12/1989 | Endo | 313/414 |
| 5,027,043 | 6/1991 | Chen et al. | 313/412 X |
| 5,027,043 | 6/1991 | Chen et al. | 315/368 |
| 5,036,258 | 7/1991 | Chen et al. | 315/382 |

FOREIGN PATENT DOCUMENTS 0178857 4/1986 European Pat. Off. .

OTHER PUBLICATIONS

*In-Line Gun with Dynamic Astigmatism and Focus Correction,* Ashizaki et al., pp. 44–47, Japan Display '86, Dec. 1986.

*An In-Line Color CRT with Dynamic Beam Shaping for Data Display,* Yamane et al., pp. 160–163, Japan Display '86, Dec. 1986.

*Progressive-Scanned 33-in. 110° Flat-Square Color CRT,* Suzuki et al. pp. 166–169, SID 87 Digest, Dec. 1987.

*Quadrupole Lens for Dynamic Focus and Astigmatism Control in an Elliptical Aperture Lens Gun,* Shirai et al., pp. 162–165, SID 87 Digest, Dec. 1987.

*Dynamic Astigmatism Control Quadra Potential Focus Gun for 21-in. Flat Square Color Display Tube,* Katsuma et al., pp. 136–139.

*Double Quadrupole DAF Gun for Self-Converging Color CRTs,* Suzuki et al., pp. 31–34, Conference Record of the 1991 International Display Research Conference, Oct. 15–17, Oct. 1991.

*Primary Examiner*—Donald J. Yusko
*Assistant Examiner*—Ashok Patel
*Attorney, Agent, or Firm*—Emrich & Dithmar

[57] ABSTRACT

In an inline electron gun for use in a color cathode ray tube (CRT), a fixed, or static, electrostatic quadrupole in the low voltage beam forming region (BFR) exerts a negative astigmatism on the electron beams in reducing beam horizontal cross-section and compensating for the horizontal under-focusing of the beams by the CRT's self-converging magnetic deflection yoke. The negative astigmatism is compensated for by a dynamic electrostatic quadrupole in the CRT's main focusing lens. The electrostatic quadrupole in the CRT's BFR includes either a plurality of spaced, horizontally oriented, aligned, elongated indentations in the $G_2$ facing surface of the $G_1$ control grid or a plurality of spaced, vertically oriented, elongated indentations in the $G_1$ facing surface of the $G_2$ screen grid, where each of the indentations has an associated through-hole circular aperture through the grid. The elongated indentations cause the cross-section of each of the electron beams to become vertically elongated particularly in the deflection region, while the dynamic electrostatic quadrupole in the main focusing lens cancels the deflection yoke's negative astigmatism without affecting electron beam cross-section shape. This invention thus incorporates a negative astigmatism and a change of beam cross-sectional shape. The negative astigmatism is later removed at the focusing lens and the benefit of the beam shape change remains.

27 Claims, 5 Drawing Sheets

WHERE $d_{H1} > d_{H2}$

BEFORE DEFLECTION
(BEAM AT CENTER)

AFTER DEFLECTION
(BEAM AT EDGE)

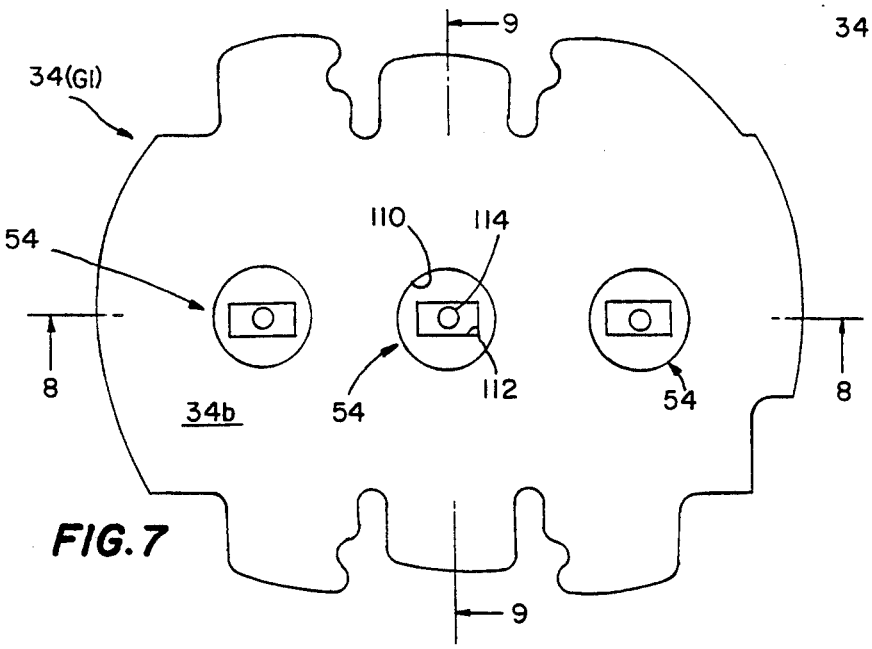
FIG. 7
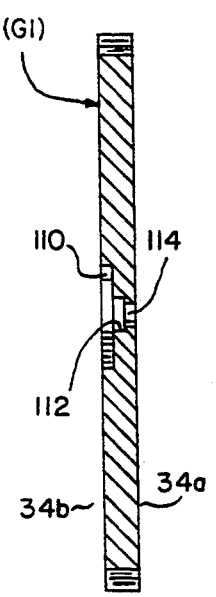
FIG. 9
FIG. 8
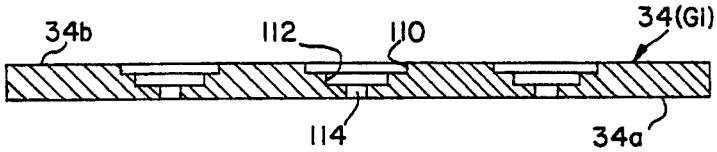
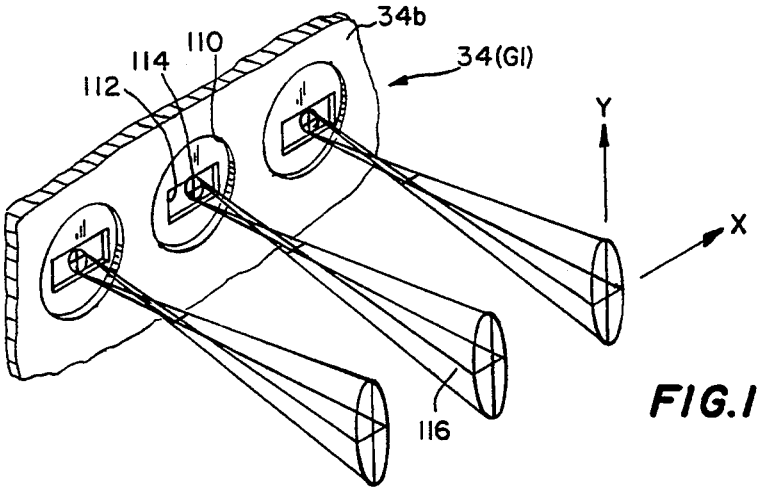
FIG. 10
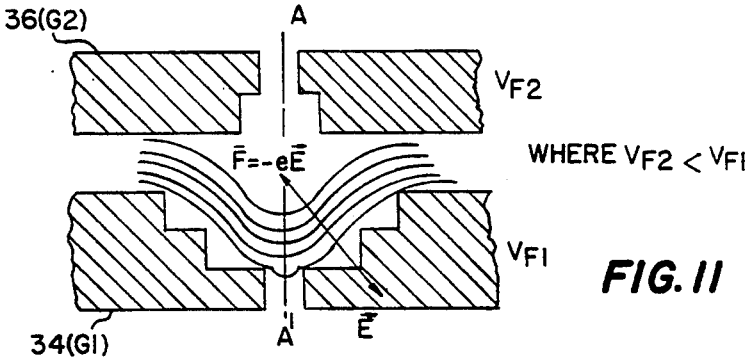
FIG. 11

INLINE ELECTRON GUN WITH NEGATIVE ASTIGMATISM BEAM FORMING AND DYNAMIC QUADRUPOLE MAIN LENS

FIELD OF THE INVENTION

This invention relates generally to electron guns such as used in a color cathode ray tube and is particularly directed to an arrangement in the beam forming region of an electron gun for providing an improved electron beam resolution or deflected beam's horizontal spot size on the cathode ray tube's screen.

BACKGROUND OF THE INVENTION

Most color cathode ray tubes (CRTs) employ an inline electron gun arrangement for directing a plurality of electron beams on the phosphor-bearing inner screen of the CRT face-plate. Most color CRTs also employ a self-converging magnetic deflection yoke for positioning each of the electron beams in common alignment as they are swept across the CRT faceplate in a synchronous manner. The self-converging deflection yoke applies a non-uniform magnetic field to the electron beams giving rise to an undesirable astigmatism in and defocusing of the electron beam spot displayed on the CRT's faceplate. In general, the magnetic field of the self-converging deflection yoke includes a dipole component and a quadrupole component. The dipole component deflects the beam in a desired direction (either horizontally or vertically in a raster-like manner), while the quadrupole component converges the three electron beams at all locations on the CRT screen as the beams are displaced across the screen. The self-converging characteristic of the magnetic quadrupole field causes the self-converging deflection yoke to exert a negative astigmatism factor on the electron beams resulting in an under-focusing of each of the beams in the horizontal direction and an over-focusing of the beams in the vertical direction.

Referring to FIG. 1, there is shown the general shape of an electron beam spot 22 on the phosphor-bearing display screen 20 of a CRT. The self-converging magnetic deflection yoke provides a non-uniform magnetic field having a strong pin cushion-like horizontal deflection magnetic field and a strong barrel-like vertical deflection magnetic field to converge the electron beams on the peripheral portion of screen 22. As the electron beams pass through the non-uniform magnetic field, the three beams are subjected to distortion and defocusing. This distortion and defocusing increases with increasing beam deflection angles. Thus, the electron beam spot 22 shown with cross-hatching in the center of screen 20 is generally circular in cross-section, while electron beam spot becomes elongated and non-circular with increasing beam deflection as shown in the top, side and corner portions of the display screen. The beam spot thus becomes horizontally elongated when deflected along the horizontal axis and becomes both horizontally and vertically elongated in the corners of the display screen 20 such that the electron beam spot assumes a generally elliptical shape with halo-shaped elongations 24 thereabout. The halo-shaped elongations 24 are of reduced peak brightness and degrade video image resolution at large beam deflections.

As shown in FIG. 1, even where there is no halo-shaped elongations 24 extending from an electron beam spot 22, such as along the vertical and horizontal center lines of the display screen 20, the beam spot still suffers from ellipticity which limits video image resolution. With reference to FIG. 2, there is shown a comparison of the length of an elliptically-shaped beam spot, $d_{H1}$, with the diameter, $d_{H2}$, of a circular beam spot, where $d_{H1} > d_{H2}$. The electron beam astigmatism shown in the beam spot of FIG. 2 is defined in terms of the difference between the horizontal focus voltage and the vertical focus voltage, or:

$$\text{Astigmatism} = V_{FH} - V_{FV}$$

where $V_{FH}$ = horizontal focus voltage, and $V_{FV}$ = vertical focus voltage.

Referring to FIGS. 3*a* and 3*b*, there is shown graphically the variation of electron beam spot size, $D_S$, with changes in horizontal focus voltage, $V_{FH}$, and vertical focus voltage, $V_{FV}$. As shown in FIG. 3*a*, with the electron beam spot at the center of the display screen, $V_{FH} = V_{FV}$ and electron beam astigmatism is zero with the beam spot having a generally circular cross-section. As the electron beam is deflected from the center of the display screen, the horizontal and vertical focus voltages change in value, with $V_{FV}$ assuming greater values than $V_{FH}$ as shown in FIG. 3*b*. Where $V_{FV} > V_{FH}$, the electron beam experiences a negative astigmatism assuming the elliptical cross-sectional shape shown in FIG. 3*b*.

Prior attempts to eliminate this negative astigmatism and deflection defocusing caused by the self-converging deflection yoke have made use of a dynamic electrostatic quadrupole lens in the main lens portion of the electron gun which is oriented 90° from the self-converging yoke's quadrupole field. A dynamic voltage, synchronized with electron beam deflection, is applied to the quadrupole lens to compensate for the astigmatism caused by the deflection system. The quadrupole lens exerts a dynamic positive astigmatism, which is in phase with, but has an opposite polarity from, the yoke's negative astigmatism for dynamic focusing of the electron beams over the CRT screen. The astigmatism of the electron beams caused by the quadrupole lens tends to offset the astigmatism caused by the color CRT's self-converging deflection yoke. To date, dynamic quadrupole lenses are capable of only improving deflected spot size in the vertical direction and offer no improvement in deflected beam horizontal spot size. This is because the self-converging deflection yoke over-focuses the electron beam in the vertical direction and the horizontal outer rays cause the problem. An electrostatic quadrupole can effectively converge these outer horizontal rays, but in the horizontal direction it is the inner rays which give rise to electron beam astigmatism and a dynamic electrostatic quadrupole has minimum effect on the inner rays of the beam.

This is shown in FIGS. 4*a*, 4*b* and 4*c*. FIG. 4*a* shows the location of inner and outer electron beam rays in the deflection yoke plane and at the display screen without the negative astigmatism of a self-converging magnetic deflection yoke. Without the self-converging deflection yoke effect, the outer electron beam rays meet the inner electron beam rays at the screen and the electron beam rays are in focus. FIG. 4*b* illustrates the situation in the horizontal plane where the self-converging deflection yoke applies a negative astigmatism to the electron beam and under-focuses the electron beam in the horizontal direction. With the electron beam horizontally under-focused, the inner rays form an image which is larger than that of the outer rays. The electron beam spot thus becomes horizontally elongated when deflected along the horizontal axis by the self-converging deflection yoke. In the vertical plane, the electron beam is over-focused by the self-converging deflection yoke as shown in FIG. 4*c* where the outer rays are displaced further from each other than the inner rays and thus form a larger image along a vertical direction.

Other prior approaches have exerted a fixed positive asymmetric correction factor on the electron beams in the beam forming region (BFR) of the electron gun. This approach generally exerts a fixed positive astigmatism on the electron beams to offset the negative astigmatism imposed by the self-converging yoke on the deflected electron beams. The negative astigmatism of the self-converging yoke used with the inline electron gun varies with yoke current and increases to a maximum at full beam deflection in the corners of the CRT screen and reduces to zero with the beams at the center of the screen. Thus, because the self-converging deflection yoke's astigmatism varies with time and the positive asymmetric correction applied in the BFR of the electron gun is fixed, this approach is a compromise and does not provide astigmatism correction over the entire display screen. This approach over-corrects at the center and under-corrects at the corners.

The aforementioned problems encountered in the prior art cause even more serious problems in high resolution color CRTs such as those having a flat faceplate and foil tension shadow mask, where the flat geometry imposes substantially greater challenges than those encountered with a curved faceplate. The present invention addresses the aforementioned problems of the prior art by reducing an electron beam bundle's horizontal cross-section such as by imposing a negative astigmatism in the CRT's beam forming region so that the deflected electron beam spot experiences less horizontal under-focusing effect from the self-converging deflection yoke for improved beam spot horizontal resolution.

OBJECTS AND SUMMARY OF THE INVENTION

Accordingly, it is an object of the present invention to impose astigmatism on an electron beam in the beam forming region of an electron gun in an inline color CRT to compensate for the horizontal under-focusing effect on the deflected electron beam spot from the CRT's self-converging deflection yoke.

Another object of the present invention is to provide improved deflected electron beam horizontal spot size and focusing in an electron gun.

Yet another object of the present invention is to change the shape of an electron beam in a CRT by means of a static, or fixed, electrostatic quadrupole in the low voltage beam forming region of an electron gun.

A further object of the present invention is to employ two astigmatism correction components in an inline multi-beam electron gun to compensate for the over-focusing of the beams in the vertical direction by a self-converging magnetic deflection yoke and to minimize beam under-focusing in the horizontal direction.

It is a more general object of the present invention to provide an improved electron gun system for color CRTs, particularly those having a planar tension mask and a flat display screen.

A still further object of the present invention is to provide improved symmetry of an electron beam spot particularly in off-center locations on a display screen by minimizing the beam distortion effect of astigmatism originating either in the electron gun or in the CRT system by compensating, in the latter case, for beam distortion induced by the use of a self-converging magnetic deflection yoke.

It is another object of the present invention to reduce or essentially eliminate the effects of astigmatism on electron beams in a multi-beam electron gun having an extended field focus lens arrangement.

A still further object of the present invention is to reduce the horizontal cross-section of each of a plurality of electron beams in a color CRT by imposing a negative astigmatism in the CRT's beam forming region so that in the deflection region each electron beam spot experiences less horizontal under-focusing by the deflection yoke.

These objects of the present invention are achieved and the disadvantages of the prior art are eliminated by an inline electron gun for directing a plurality of electron beams on a display screen in a color cathode ray tube (CRT) having a self-converging magnetic deflection yoke for deflecting the electron beams across the display screen in a raster-like manner, wherein the deflection yoke horizontally under-focuses the electron beams as the electron beams are deflected toward a lateral edge of the display screen and vertically over-focuses the electron beams, the electron gun including a source of energetic electrons, the electron gun comprising: a low voltage beam forming arrangement disposed adjacent the source of energetic electrons for forming the energetic electrons into a plurality of electron beams; a high voltage beam focusing arrangement disposed intermediate the beam forming arrangement and the display screen for receiving and focusing each of the electron beams on the display screen; an electrostatic asymmetric focusing arrangement in the low voltage beam forming arrangement for applying a negative astigmatism in each of the electron beams in horizontally over-focusing the electron beams and reducing electron beam horizontal cross-section; and a dynamic electrostatic quadrupole disposed in the high voltage beam focusing arrangement for introducing a positive astigmatism in each of the electron beams to compensate for the negative astigmatism introduced by the electrostatic asymmetric focusing arrangement and by the deflection yoke for improved electron beam horizontal resolution on the display screen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 7 is an elevation view of the $G_2$ side of the $G_1$ control grid employed in one embodiment of the inventive electron gun shown in FIGS. 5 and 6;

FIGS. 8 and 9 are respectively horizontal and vertical sectional views of the $G_1$ control grid shown in FIG. 7 taken respectively along site lines 8—8 and 9—9 therein;

FIG. 10 is a perspective view of the $G_1$ control grid employed in the present invention illustrating the effect on electron beam shape of a $G_1$ static electrostatic quadrupole in accordance with one embodiment of the present invention;

FIG. 11 is a simplified sectional view illustrating the electrostatic equipotential lines and electrostatic force applied to an electron beam between the $G_1$ control and $G_2$ screen electrodes in accordance with one embodiment of the present invention;

DETAILED DESCRIPTION OF THE PREFERRED EMBODIMENTS

Figure 1:
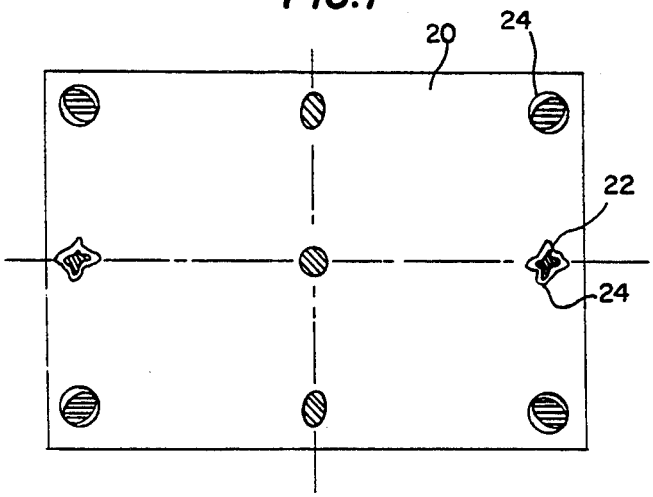
FIG. 1 is a schematic representation of a color CRT display screen illustrating the various shapes assumed by electron beam spots at various locations on the screen.
Figure 2:
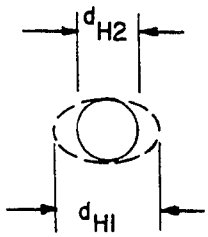
FIG. 2 is a simplified representation of the distortion of a spot on a display screen of an electron beam having a circular cross-section on the screen center and an elongated cross-section on the screen edges.
Figure 3A:
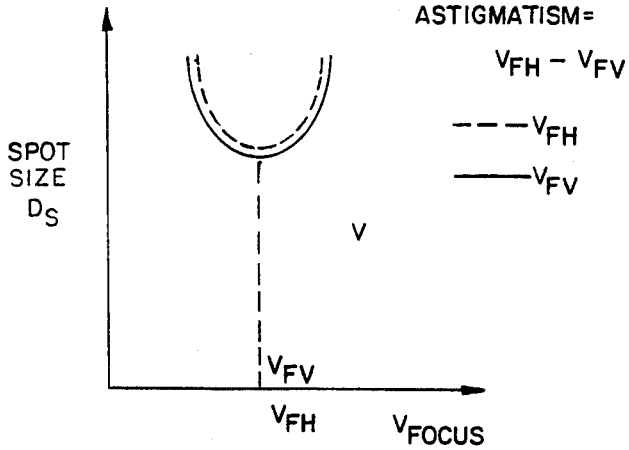
FIGS. 3*a* and 3*b* provide a graphic comparison of electron beam spot size ($D_S$) in terms of horizontal and vertical focusing voltages applied to the beam before and after beam deflection, respectively.
Figure 3B:
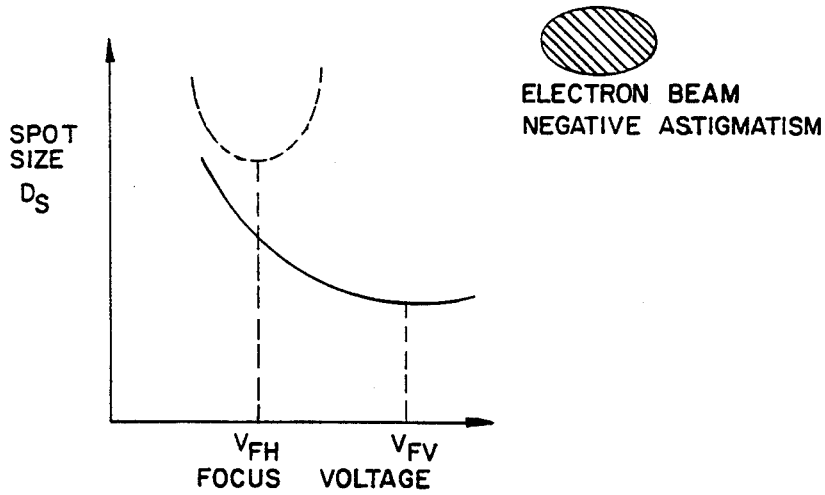
Figure 4A:
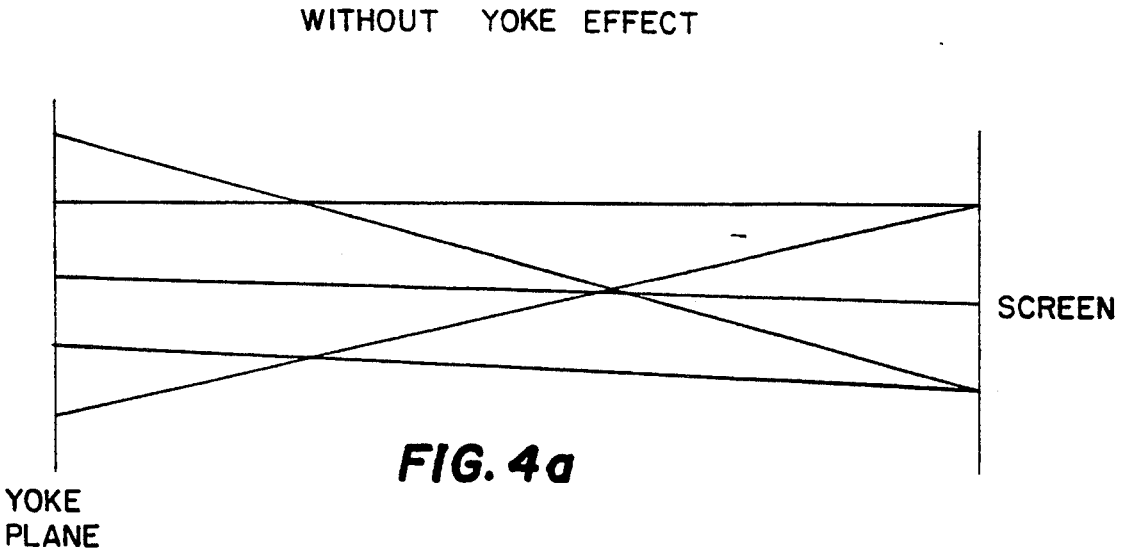
FIGS. 4*a*, 4*b* and 4*c* are simplified electron beam ray diagrams illustrating the vertical over-focusing and horizontal under-focusing of an electron beam by a self-converging magnetic deflection yoke.
Figure 4B:
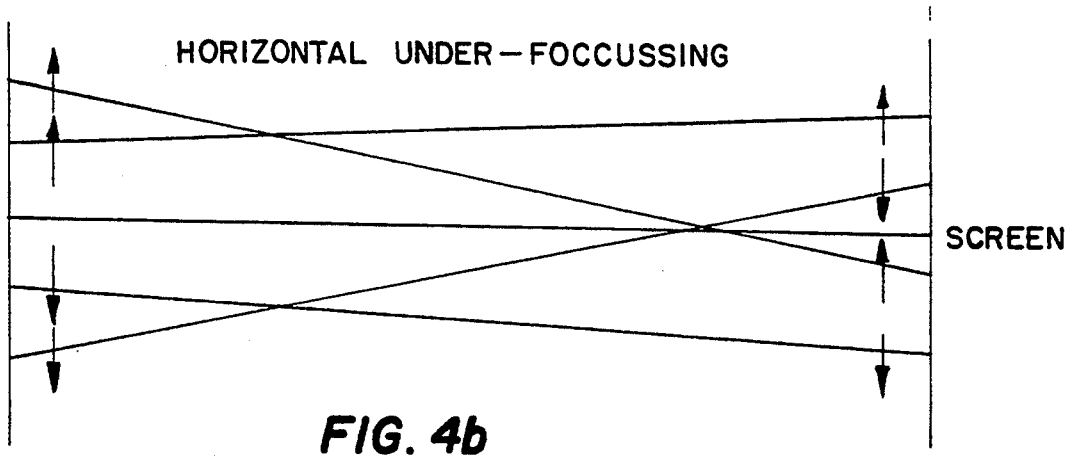
Figure 4C:
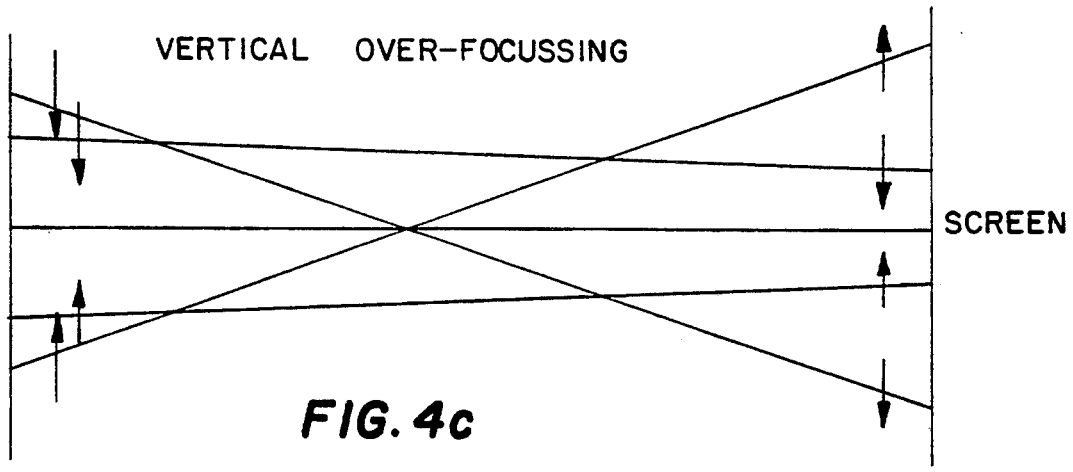
Figure 5:
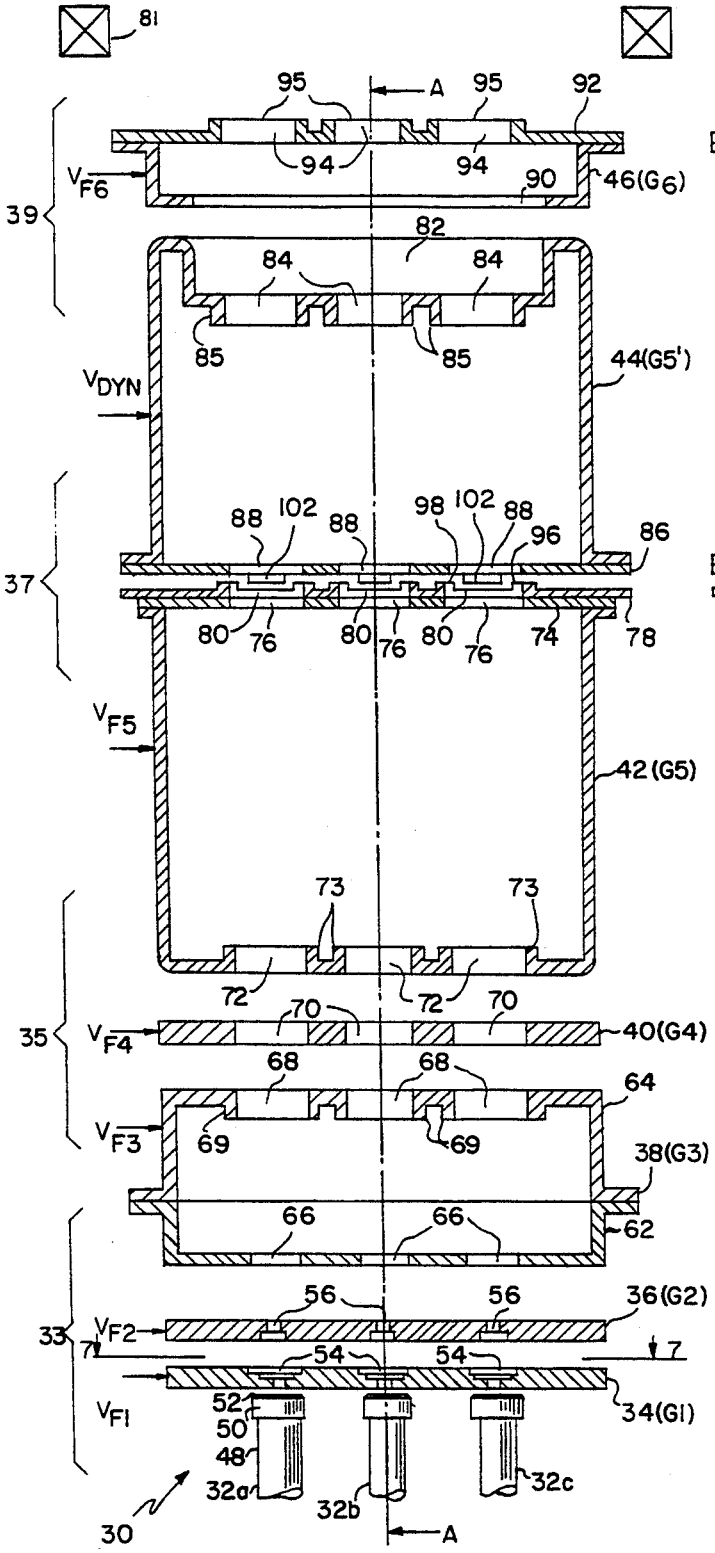
FIGS. 5 and 6 are axial top and side views, respectively, shown partially in schematic diagram form and partially cut-away of an electron gun with a static electrostatic quadrupole in the beam forming region and a dynamic quadrupole main lens in accordance with the principles of the present invention.
Figure 6:
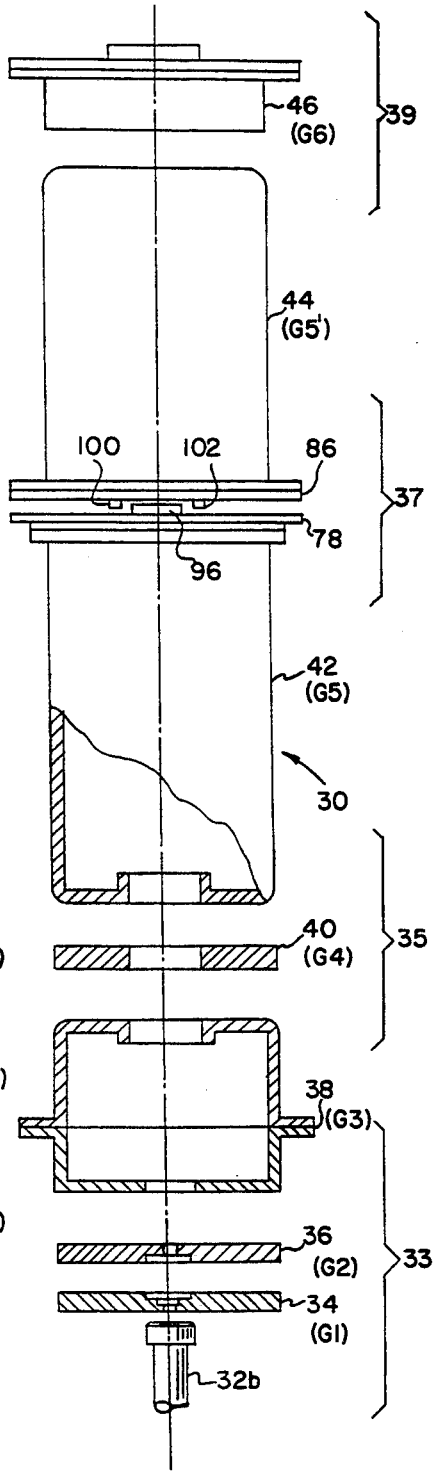

Referring to FIGS. 5 and 6, there are respectively shown axial top and side views of an electron gun 30 in accordance with the principles of the present invention. Electron gun 30 includes three equally spaced co-planar cathodes 32*a*, 32*b* and 32*c* (one for each beam), a control grid 34 ($G_1$), a screen grid 36 ($G_2$), a third electrode 38 ($G_3$), a fourth electrode 40 ($G_4$), a fifth electrode 42 ($G_5$), where the $G_5$ electrode includes a portion $G_5'$ identified as element 44, and a sixth electrode 46 ($G_6$). The electrodes are spaced in the recited order from the cathodes 32*a*, 32*b* and 32*c* and are attached to a conventional support arrangement such as a pair of glass rods, which are not shown in the figure for simplicity. In the following discussion, the terms "electrode" and "grid" are used interchangeably.

Cathodes 32*a*, 32*b* and 32*c*, the $G_1$ electrode 34, the $G_2$ electrode 36, and a portion of the $G_3$ electrode 38 facing the $G_2$ electrode comprise a beam forming region (BFR) 33 of the electron gun 30. Another portion of the $G_3$ electrode 38, the $G_4$ electrode 40, and a portion of the $G_5$ electrode 42 facing the $G_4$ electrode comprise a symmetric prefocus lens 35 of the electron gun 30. Facing portions of the $G_5$ electrode 42 and the $G_5'$ electrode 44 form a dynamic quadrupole 37 as described below, while that portion of the $G_5'$ electrode facing the $G_6$ electrode 46 and the $G_6$ electrode itself form the main focus lens 37 of electron gun 30. A magnetic deflection yoke 81 is disposed intermediate the $G_6$ electrode and a display screen (not shown in the figure for simplicity) of a CRT in which the electron gun 30 is employed.

Various voltages, or potentials, as these terms are used interchangeably in the following discussion, are applied to the various electrodes as indicated in FIG. 5. For example, fixed voltages $V_{F1}$, $V_{F2}$ and $V_{F3}$ are respectively applied to the $G_1$, $G_2$ and $G_3$ electrodes 34, 36 and 38. Similarly, fixed voltages $V_{F4}$ and $V_{F5}$ are applied to the $G_4$ electrode 40 and to the $G_5$ electrode 42. A dynamic voltage $V_{DYN}$ is applied to the $G_5'$ electrode 44. The $G_3$ and $G_5$ electrodes 38, 42 are electrically interconnected and operate at the same potential of about 7 kV. The $G_6$ electrode 46 operates at an anode potential of about 25 kV, while the cathodes operate at about 150 V, the $G_1$ electrode 34 is essentially at ground potential, and the $G_2$ and $G_4$ electrodes are electrically interconnected and operate within the range of about 300 V to 1000 V. The dynamic $V_{DYN}$ voltage applied to the $G_5'$ electrode 44 establishes a dynamic electrostatic quadrupole in between the $G_5'$ electrode and the facing portion of the $G_5$ electrode 42. By applying to the $G_5'$ electrode 44 a dynamic differential focus voltage that ranges from the potential on the $G_5$ electrode 42, with no deflection, to about 1000 volts more positive than the voltage applied to the $G_5$ electrode at maximum deflection, the deflected electron beam current density contour can be improved as set forth in U.S. Pat. No. 4,764,704. Further details of the configuration and operation of the several embodiments of the inventive electron gun 30 are set forth in the following paragraphs.

Each cathode 32*a*, 32*b* and 32*c* comprises a cathode sleeve 48 closed at its forward end by a cap 50 having an end coating 52 of an electron emissive material thereon as is well known in the art. Each cathode 32*a*, 32*b* and 32*c* is indirectly heated by a heater coil (not shown in the figures for simplicity) disposed within sleeve 48.

The $G_1$ and $G_2$ electrodes 34, 36 form a static, or fixed, electrostatic quadrupole in the form of substantially flat plates disposed in closely spaced relation and having three pairs of inline apertures, or openings, 54 and 56, respectively, therethrough. Apertures 54 and 56 are centered with the cathode coating 52 to form three equally spaced coplanar electron beams (which also are not shown in the figures for simplicity) directed toward a display screen which is disposed above electron gun 30 as shown in FIGS. 5 and 6, but also is not included in the figures for simplicity. Each of the three initial electron beam paths are substantially parallel, with the middle electron beam path coinciding with the central axis A—A of electron gun 30.

The $G_3$ electrode 38 includes a pair of cup-shaped first and second portions 62 and 64, respectively, which are joined together at their open ends. The first portion 62 includes three inline apertures 66 formed through the bottom of the cup which apertures are aligned with the apertures 54 and 56 in the $G_1$ and $G_2$ electrodes 34 and 36. The second portion 64 of the $G_3$ electrode 38 also includes three apertures 68 formed through its bottom which are aligned with respective apertures 66 in the first portion 62. Extrusions 69 surround each of the apertures 68 in the second portion 64 of the $G_3$ electrode 38.

The $G_4$ electrode 40 comprises a substantially flat plate having three inline apertures 70 formed therethrough which are each aligned with a respective one of apertures 68 in the $G_3$ electrode 38.

The $G_5$ electrode 42 is a deep-drawn, cup-shaped member having three apertures 72, each surrounded by a respective extrusion 73, formed in the bottom end of the $G_5$ electrode. A substantially flat plate member 74 having three apertures 76, aligned with the apertures 72 is attached to and closes the open end of the $G_5$ electrode 42. A first plate portion 78, having a plurality of apertures 80 therein, is attached to the opposite surface of plate member 74.

The $G_5'$ electrode 44 comprises a deep-drawn, cup-shaped member having a recess 82 formed in the bottom end with three inline apertures 84 formed in the bottom surface thereof. Extrusions 85 surround each of the apertures 84. The opposite open end of the $G_5'$ electrode 44 is closed by a second plate portion 86 having three apertures 88 formed therethrough which are aligned with and cooperate with the apertures 80 in the first plate portion 78 as described below.

The $G_6$ electrode 46 is a cup-shaped, deep-drawn member having a large aperture 90 at one end through which all three electron beams pass and an open end which is attached to and closed by a plate member 92 that has three apertures 94 therethrough. Each of the apertures 94 is aligned with a respective one of apertures 84 in the $G_5'$ electrode 44. Extrusions 95 surround each of the apertures 94 in plate member 92.

Recess 82 in the $G_5'$ electrode 44 has a uniform vertical width at each of the electron beam paths with rounded ends. Such a shape is generally referred to as a "race track" shape. Aperture 90 in the $G_6$ electrode 46 is vertically higher at the side electron beam paths than it is at the center beam path. Such a shape is generally referred to as a "dogbone" or "barbell" shape.

The first plate portion 78 of the $G_5$ electrode 42 faces the second plate portion 86 of the $G_5'$ electrode 44. Apertures, or openings, 80 in the first plate portion 78 of the $G_5$ electrode 42 have extrusions extending from the plate portion which are divided into two segments 96 and 98 for each aperture. Apertures 88 in the second plate portion 86 of the $G_5'$ electrode 44 also have extrusions extending from the plate portion 86 which are divided into two segments 100 and 102 for each aperture. Segments 96 and 98 are interleaved with segments 100 and 102. These segments are used to create quadrupole lenses in the paths of each electron beam when different potentials are applied to the $G_5$ and $G_5'$ electrodes 42 and 44, respectively. By proper application of a dynamic voltage differential to the $G_5'$ electrode 44, it is possible to use the quadrupole lenses established by the segments 96, 98, 100 and 102 to provide an astigmatic correction to the electron beams to compensate for astigmatism occurring in either the electron gun or in the self-converging magnetic deflection yoke, which is not shown in the figure for simplicity.

The dynamic focusing voltage $V_{DYN}$ applied to the $G_5'$ electrode 44 varies in a periodic manner between a minimum value and a maximum value. The minimum $V_{DYN}$ voltage is applied to the $G_5'$ electrode 44 when the electron beams are positioned along a vertical center line of the CRT screen. This minimum value of $V_{DYN}$ is essentially the voltage applied to the $G_5$ electrode 42. As the electrons are deflected horizontally in a first direction, the dynamic focus voltage $V_{DYN}$ increases to a value on the order of 1000 volts with the electron beams fully deflected. This maximum difference between $V_{DYN}$ and $V_{F5}$ is again provided at the start of the next horizontal sweep, only to decrease to zero as the electron beams are swept toward the vertical center line of the CRT screen. In some color CRTs currently in use such as those of the Combined Optimum Tube and Yoke (COTY) type, the dynamic focus voltage $V_{DYN}$ is varied in a periodic manner, but does not go below the fixed focus voltage $V_{F5}$. The dynamic focus voltage $V_{DYN}$ is applied to the $G_5'$ electrode 44 synchronously with the deflection yoke current to change the quadrupole fields applied to the electron beams so as to either converge or diverge the electron beams, depending upon their position on the CRT screen, in correcting for deflection yoke-producing astigmatism and beam defocusing effects. In general, when the electron beams are deflected to a position displaced from the center line of the CRT screen, the dynamic electrostatic quadrupole formed by the $G_5$ electrode 42 and the $G_5'$ electrode 44 introduces a positive astigmatism correction for the electron beams to correct for the negative astigmatism effects of the self-converging deflection yoke. In non-COTY CRTs, the $G_5$ and $G_5'$ electrodes 42, 44 are maintained at the same voltage when the electron beams are positioned on a vertical center portion of the CRT screen. A negative astigmatism correction is introduced by the dynamic quadrupole lens comprised of the $G_5$ and $G_5'$ electrodes 42, 44 to compensate for the positive astigmatism effects of a COTY-type main lens on the electron beams in the center of the CRT screen. A dynamic electrostatic quadrupole may also be established by the $G_5$ electrode and the $G_5'$ electrode 42, 44 by providing each of the apertures 76 in the $G_5$ electrode with a generally rectangular, vertically elongated shape as is well known to those skilled in the relevant arts.

Cathodes **32*a*, 32*b* and 32*c* are typically operated at approximately 150 V, while the $G_4$ electrode 40 is operated at a fixed voltage $V_{F4}$ within the range of approximately 300 V to 1000 V. The $G_3$ electrode 38 is operated at a fixed voltage $V_{F3}$ of approximately 7 kV and the $G_6$ electrode 46 operates at a fixed voltage $V_{F6}$ equal to the anode potential of approximately 25 kV. Dynamic focusing voltage $V_{DYN}$ is varied in a periodic manner relative to the fixed $V_{F5}$ voltage provided to the $G_5'$ electrode 44 to establish a dynamic electrostatic quadrupole in the main focusing lens portion of the electron gun 30. A modulated video signal is provided to the three cathodes 32*a*, 32*b* and 32*c*. The $G_1$ and $G_2$ electrodes 34, 36** are maintained at different voltages to control electron beam cut-off and exert an electrostatic quadrupole effect on the three electron beams as described below.

Referring to FIG. 7, there is shown an elevation view of the $G_2$ side **34*b* of the $G_1$ electrode 34 in accordance with one embodiment of the present invention. Horizontal and vertical sectional views of the $G_1$ electrode 34 shown in FIG. 7 respectively taken along site lines 8—8 and 9—9 are shown in the sectional views of FIGS. 8 and 9. Each of the apertures 54 includes a through-hole circular aperture 114 disposed on a cathode-facing side 34a of the $G_1$ electrode 34. In proceeding in the direction of the $G_3$ electrode 38, each through-hole circular aperture 114 leads to and is continuous with a horizontally oriented, elongated indentation 112. Disposed about each of the elongated indentations 112 and extending inward from a $G_3$ electrode-facing side 34b of the $G_1$ electrode 34 is a circular shaped indentation 110. The circular shaped indentation 110 and the through-hole circular aperture 114 are aligned along a common axis to permit an electron beam to transit the $G_1$ electrode 34. Each through-hole circular aperture 114 has a diameter less than or equal to the shorter side of its associated elongated indentation 112**.

Referring to FIG. 10, there is shown the manner in which each of the elongated indentations 112 over-focus a respective electron beam in a horizontal direction (X-axis of electron gun) and under-focus the beam in a generally vertical direction (Y-axis of electron gun). The low voltage BFR 33 changes electron beam cross-sectional shape by applying a negative astigmatism to the beam to reduce the underfocusing effect of the self-converging magnetic deflection yoke in the horizontal direction.

Referring to FIG. 11, there is shown a simplified illustration of the manner in which an electrostatic field, represented by the field vector $\vec{E}$ applies a force, represented by the force vector $\vec{F}$, to an electron passing between the $G_1$ and $G_2$ electrodes 34, 36. An electrostatic field is formed between two charged electrodes, with the upper electrode charged to a voltage of $V_{F2}$ and a lower electrode charged to a voltage $V_{F1}$, where $V_{F2}$ is greater than $V_{F1}$. With $V_{F2}>V_{F1}$, the electrostatic field vector $\vec{E}$ is directed toward the $G_1$ electrode 34, while the force vector $\vec{F}$ is directed toward the $G_2$ electrode 36 because of the electron's negative charge. FIG. 11 provides a simplified illustration of the electrostatic force applied to an electron, or an electron beam, directed through apertures in adjacent charged electrodes which are maintained at different voltages. It can be seen that the relative width of the two apertures in the two electrodes 34 and 36 as well as the relative polarity of the two electrodes determines whether the electron beam is directed away from the A—A' axis in diverging the electron beam, or toward the A—A' axis in converging the electron beam. The horizontally aligned, generally rectangular elongated indentations 112 in the $G_2$ facing surface 34b of the $G_1$ electrode 34 converge, or over-focus, the electron beam rays horizontally in accordance with the present invention.

Figure 12:
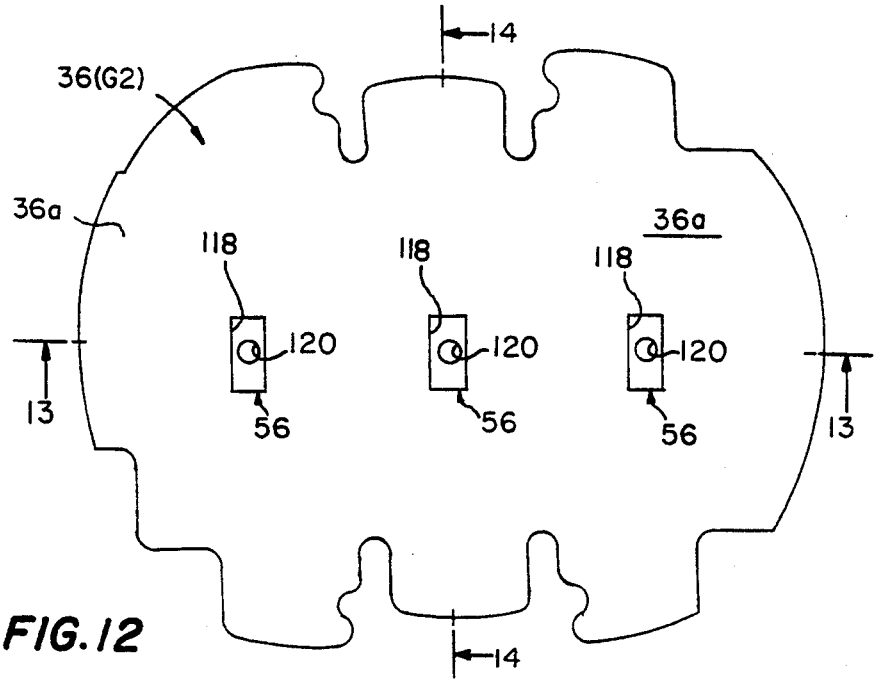
FIG. 12 is an elevation view of the $G_1$ side of a $G_2$ screen grid in accordance with another embodiment of the present invention.
Figure 14:
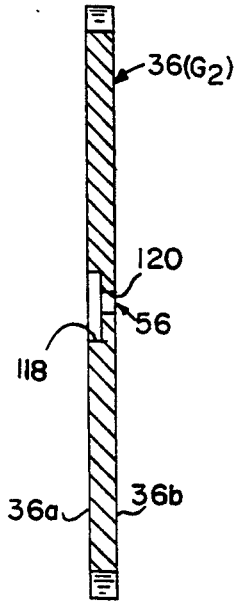
FIGS. 13 and 14 are respectively horizontal and vertical sectional views of the $G_2$ screen grid shown in FIG. 10 respectively taken along site lines 13—13 and 14—14 therein.
Figure 13:
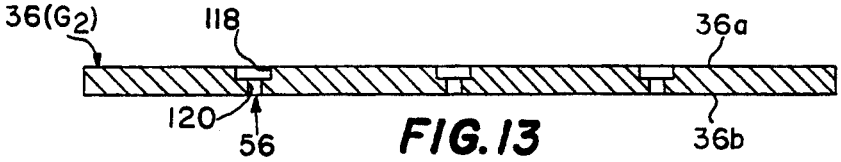

Referring to FIG. 12, there is shown an elevation view of the $G_1$ side of the $G_2$ electrode 36 in accordance with another embodiment of the present invention. Horizontal and sectional views of the $G_2$ electrode 36 of FIG. 12 respectively taken along site lines 13—13 and 14—14 are shown in FIGS. 13 and 14. The $G_2$ electrode 36 includes a $G_1$ facing side 36a and a $G_3$ facing side 36b. Each of the three apertures 56 in the $G_2$ electrode 36 includes an elongated indentation 118 facing the $G_1$ electrode 34 and a through-hole circular aperture 120 facing the $G_3$ electrode 38. Each through-hole circular aperture 120 is aligned with and centered on its associated elongated indentation 118. Each through-hole circular aperture 120 has a diameter $\leqq$ a shorter side of its associated rectangular beam inlet portion 118. Each of the elongated indentations 118 has its longitudinal axis aligned generally vertically.

Figure 15:
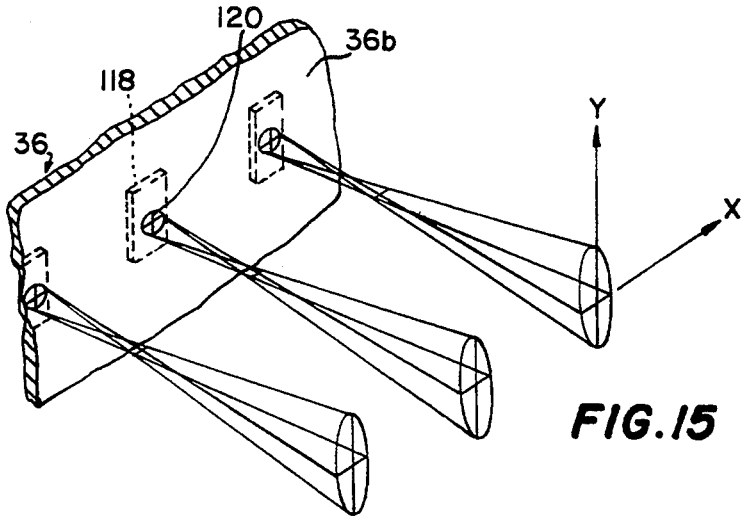
FIG. 15 is a perspective view of the inventive $G_2$ control grid shown in FIG. 12 illustrating the beam forming characteristics of the $G_2$ screen grid in accordance with a second embodiment of the present invention.
Figure 16:
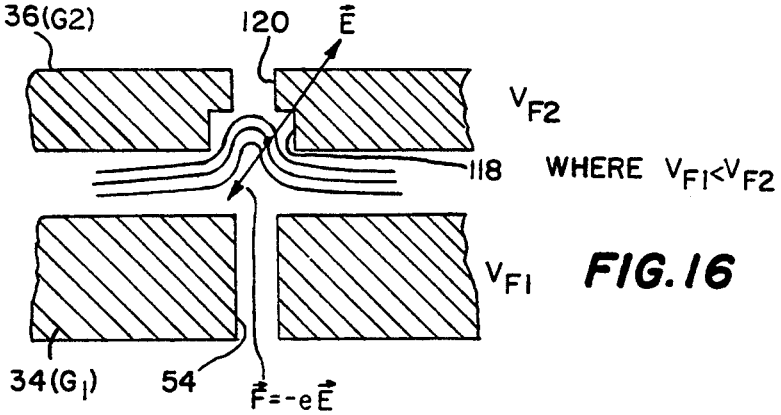
FIG. 16 is a simplified sectional view illustrating the electrostatic equipotential lines and electrostatic force applied to an electron between the $G_1$ control and $G_2$ screen electrodes in accordance with another embodiment of the present invention.

In this embodiment, each of the three apertures 54 in the $G_1$ electrode 34 are generally circular in cross-section and have a fixed diameter through the $G_1$ electrode. With each elongated indentation 118 on a low voltage side of the $G_2$ electrode 36 and facing the $G_1$ electrode 34, each aperture 56 will over-focus its associated electron beam horizontally and under-focus the beam vertically as shown in the perspective view of the $G_3$ facing side 36b of the $G_2$ electrode 36 in FIG. 15. This is shown in FIG. 16 which is a simplified horizontal sectional view illustrating the electrostatic equipotential lines and electrostatic force applied to an electron between the $G_1$ control and $G_2$ screen electrodes in accordance with this second embodiment of the invention. With $V_{F2}$ greater than $V_{F1}$, and with the longitudinal axis of each generally rectangular slot in the $G_2$ electrode 36 oriented generally vertical, each electron beam will be horizontally converged with an inwardly directed force $\vec{F}$ exerted on the electrons due to the electrostatic field $\vec{E}$ disposed intermediate the $G_1$ and $G_2$ electrodes 34, 36.

The electrostatic quadrupole in the low voltage BFR 33 of the electron gun 30 reduces electron beam horizontal spot size in the deflection region. Reducing electron beam horizontal spot size not only does not affect the inline deflection yoke's self-convergence function, but due to a smaller beam dimension in the horizontal direction the electron beam over its entire horizontal dimension will be subject to a reduced horizontal under-focusing effect. In addition, imposing an electrostatic quadrupole on the electron beam in a low voltage portion of the beam path affects both inner and outer electron beam rays in correcting for electron beam astigmatism. The electron beam experiences a positive electrostatic quadrupole effect which causes the beam to elongate along the Y-axis when it reaches the deflection region. Because each of the elongated indentations 112 is located in the $G_1$ electrode 34 where the electron beam has very low kinetic energy (less than 100 V of kinetic energy), the electrostatic quadrupole effect will be experienced by both inner and outer electron beam rays. In the case of the second embodiment described above, electrons have been accelerated to a kinetic energy approximately equal to the $G_2$ electrode 36 voltage. The electron beam shape change in this embodiment of the invention as shown in FIG. 15 is somewhat less than that compared to the effect of the $G_1$ elongated indentation 112 on the beam because of the increased kinetic energy (and velocity) of the electrons in the region of the $G_2$ electrode 36. Placing the elongated indentation 118 on the $G_3$ side of the $G_2$ electrode 36 has less of an effect on electron beam horizontal spot size because the electrons at this point in the electron gun 30 have a kinetic energy above that of the $G_2$ electrode voltage. In addition, locating the elongated beam passing apertures on the high voltage side of the $G_2$ electrode 36 gives rise to electron beam cross-over problems.

The present invention thus employs two asymmetric correction components in the electron gun to compensate for the self-converging deflection yoke's over-focusing of the electron beam in the vertical direction and under-focusing of the deflected beam in the horizontal direction. These two asymmetric correction components include a first dynamic quadrupole in the main focusing lens portion of the electron gun and a second electrostatic quadrupole in the low voltage beam forming region of the electron gun. The fixed slots through which the electron beams are directed in either the $G_1$ control grid (horizontally aligned slots) or in the $G_2$ screen grid (vertically aligned slots) impose a negative astigmatism correction having the same polarity as that of the self-converging inline magnetic deflection yoke on the beams.

The electron gun of the present invention requires a larger positive DC biased voltage applied to the dynamic quadrupole $G_5'$ electrode 44 when the electron beam is undeflected. The dynamic bias voltage is defined as $V_{DYN}-V_{F5}$, where $V_{DYN}$ is the voltage applied on the $G_5'$ grid 44 next to the $G_6$ grid 46 with the anode voltage, and $V_{F5}$ is the focus voltage applied to the $G_5$ grid 42. Additional pairs of grids to which $V_{DYN}$ and $V_{F5}$ are applied may be incorporated in electron gun 30 to provide additional dynamic electrostatic quadrupole correction for the negative astigmatism of the electron beams. In a conventional dynamic quadrupole electron gun design, when $V_{DYN}>V_{F5}$, the dynamic quadrupole region creates a positive quadrupole lens which imposes a positive astigmatism on the electron beam passing through the region. This occurs in a quadrupole employed in the electron gun of the present invention at full electron beam deflection. The "astigmatism" is defined as the difference between the horizontal focus voltage $V_{FH}$ and the vertical focus voltage $V_{FV}$. If $V_{FH}-V_{FV}$ is positive, the beam has positive astigmatism, or vice versa. In the electron gun of the present invention, the electron beam experiences a negative astigmatism as it leaves the $G_1$ control electrode. At the center of the display screen, there is no self-converging deflection yoke imposed astigmatism, so the dynamic quadrupole region's static bias should be $V_{DYN}>V_{F5}$, which creates a positive astigmatism to compensate the beam forming region's negative astigmatism. When the electron beam is deflected toward the screen edge and/or corner, a dynamic delta $\delta V_{DYN}$ is superimposed on the focus voltage $V_{DYN}$.

There has thus been shown an inline electron gun for use in a color CRT which includes a first high voltage main focusing lens dynamic electrostatic quadrupole and a second low voltage beam forming region electrostatic quadrupole for compensating for self-converging deflection yoke imposed horizontal under-focusing effect on the electron beams. The electrostatic quadrupole in the beam forming region of the electron gun applies a negative astigmatism for reducing the horizontal dimensions of the three individual electron beams in the deflection region. Elongated slots in either the $G_1$ control grid (horizontal slots) or in the $G_2$ screen grid (vertical slots) exert a negative electrostatic quadrupole affect on each of the beams causing the beams to elongate in cross-section along the Y-axis and to contract in cross-section along the X-axis in the deflection region. The inline electron gun with asymmetric beam forming via electrostatic quadrupoles in the beam forming and main lens portions of the gun provides improved deflected electron beam spot size and electron beam focusing for enhanced video image resolution. This invention thus reduces electron beam bundle horizontal cross-section by imposing a negative astigmatism in the beam forming region so that the deflected electron beam experiences reduced horizontal under-focusing for improved electron beam spot horizontal resolution on the CRT screen.

While particular embodiments of the present invention have been shown and described, it will be obvious to those skilled in the art that changes and modifications may be made without departing from the invention in its broader aspects. For example, while the slots in the $G_1$ control electrode and the $G_2$ screen electrode are described as being rectangular, the present invention is not limited to this shape as virtually any elongated slot shape will operate equally as well. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An inline electron gun for directing a plurality of electron beams on a display screen in a color cathode ray tube (CRT) having a self-converging magnetic deflection yoke for deflecting said electron beams across said display screen in a raster-like manner, wherein said deflection yoke horizontally under-focuses the electron beams as the electron beams are deflected toward a lateral edge of said display screen and vertically over-focuses the electron beams, said electron gun including a source of energetic electrons, said electron gun comprising:

low voltage beam forming means disposed adjacent the source of energetic electrons for forming the energetic electrons into the plurality of electron beams;

high voltage beam focusing means disposed intermediate said beam forming means and the display screen for receiving and focusing each of the electron beams on the display screen;

static electrostatic quadrupole means disposed in said low voltage beam forming means for applying a negative astigmatism to each of the electron beams in horizontally over-focusing the electron beams and reducing a spot size of each electron beam in a horizontal cross-section; and dynamic electrostatic quadrupole means disposed in said high voltage beam focusing means for introducing a positive astigmatism into each of the electron beams to compensate for the negative astigmatism introduced by said static electrostatic quadrupole means and by the deflection yoke for improved electron beam spot resolution on the display screen.

2. The electron gun of claim 1 wherein said static electrostatic quadrupole means includes, in combination, a charged $G_1$ control electrode and a charged $G_2$ screen electrode, and wherein said $G_1$ control electrode is disposed intermediate said $G_2$ screen electrode and the source of energetic electrons.

3. The electron gun of claim 2 wherein said $G_1$ control electrode is maintained at a first fixed voltage $V_{F1}$ and said $G_2$ screen electrode is maintained at a second fixed voltage $V_{F2}$, where $V_{F2}>V_{F1}$.

4. The electron gun of claim 3 wherein said $G_1$ control electrode includes a plurality of elongated, aligned indentations through each of which a respective one of the electron beams is directed, and wherein a longitudinal axis of each of the elongated indentations is oriented generally horizontally, or along an X-axis of the electron gun.

5. The electron gun of claim 4 wherein each of said elongated indentations is generally rectangular.

6. The electron gun of claim 5 wherein each of said elongated indentations is disposed toward a first surface side of said $G_1$ control electrode facing said $G_2$ screen electrode.

7. The electron gun of claim 6 wherein said $G_1$ control electrode further includes a plurality of spaced through-hole circular apertures disposed toward a second opposed surface side of said $G_1$ control electrode facing the source of energetic electrons, and wherein each of said circular apertures is aligned with a respective one of said rectangular indentations such that each of said electron beams passes through a respective combination of a circular aperture and a rectangular indentation.

8. The electron gun of claim 7 wherein each of said circular apertures has a diameter less than or equal to the length of a shorter side of its associated rectangular indentation with which it is in communication.

9. The electron gun of claim 8 wherein said $G_1$ control electrode further includes a plurality of circular shaped indentations each disposed toward the first surface side thereof and coaxially aligned with a respective one of said rectangular indentations.

10. The electron gun of claim 3 wherein said $G_2$ screen electrode includes a plurality of elongated indentations through each of which a respective one of the electron beams is directed, and wherein a longitudinal axis of each of said elongated indentations is oriented generally vertically, or along a Y-axis of the electron gun.

11. The electron gun of claim 10 wherein each of said elongated indentations is generally rectangular.

12. The electron gun of claim 11 wherein each of said rectangular indentations is disposed toward a first surface side of said $G_2$ screen electrode facing said $G_1$ control electrode.

13. The electron gun of claim 12 wherein said $G_2$ screen electrode further includes a plurality of spaced through-hole circular apertures disposed toward a second opposed surface side of said $G_2$ screen electrode facing said high voltage beam focusing means, and wherein each of said circular apertures is aligned with a respective one of said rectangular indentations such that each of said electron beams passes through a respective combination of a rectangular indentation and a circular aperture.

14. The electron gun of claim 13 wherein each of said circular apertures has a diameter less than or equal to the length of a shorter side of its associated rectangular indentation with which it is in communication.

15. The electron gun of claim 14 wherein said $G_1$ control electrode includes a plurality of spaced circular shaped indentations each coaxially aligned with an associated rectangular indentation in said $G_2$ screen electrode for directing a respective one of said electron beams through said associated rectangular indentation.

16. For use in a color cathode ray tube (CRT) including three inline cathodes for providing three groups of energetic electrons and having a display screen and a self-converging magnetic deflection yoke for deflecting a plurality of electron beams across said display screen in a raster-like manner, wherein said deflection yoke imparts a negative astigmatism in a beam deflection zone to the beams incident on the screen, giving rise to beam horizontal under-focusing, said CRT further including a high voltage lens portion including a dynamic electrostatic quadrupole for focusing the beams on the screen, a low voltage electron beam forming arrangement comprising:

a first charged electrode having a first plurality of inline through-hole circular apertures each aligned with a respective one of said cathodes and having an associated aligned rectangular indentation; and a second charged electrode having a second plurality of inline through-hole circular apertures each aligned with a respective one of said first plurality of apertures in said first charged electrode, wherein each of said aligned first and second pluralities of through-hole circular apertures and said aligned rectangular indentation receives one of said three groups of energetic electrons and forms said energetic electrons into an electron beam and provides said electron beam to the high voltage lens portion of the CRT, wherein said first charged electrode is a $G_1$ control electrode maintained at a first voltage $V_{F1}$ and said second charged electrode is a $G_2$ control electrode maintained at a second voltage $V_{F2}$, and wherein $V_{F2}>V_{F1}$ and said $G_1$ control electrode and said $G_2$ screen electrode comprise a static electrostatic quadrupole;

wherein said electrodes apply a fixed negative astigmatism to each of the electron beams in a horizontal overfocusing of the electron beams to reduce the horizontal beam size in the deflection zone and improve the deflected electron beam's horizontal resolution.

17. The low voltage electron beam forming arrangement of claim 16 wherein said first plurality of inline apertures are disposed toward a first surface side of said $G_1$ control electrode, and wherein said first surface side is in facing relation to said cathodes.

18. The low voltage electron beam forming arrangement of claim 17 wherein said $G_1$ control electrode further includes a plurality of generally circular shaped indentations disposed toward a second opposed surface side thereof, and wherein each generally circular shaped indentation is aligned with a respective one of said first plurality of apertures for passing a respective one of said electron beams.

19. The low voltage electron beam forming arrangement of claim 18 wherein each of said rectangular indentations has a longitudinal axis oriented generally horizontally, or in alignment with the three inline cathodes.

20. The low voltage electron beam forming arrangement of claim 19 wherein said $G_1$ control electrode is disposed intermediate said cathodes and said $G_2$ screen electrode.

21. For use in a color cathode ray tube (CRT) including three inline cathodes for providing three groups of energetic electrons and having a display screen and a self-converging magnetic deflection yoke for deflecting a plurality of electron beams across said display screen in a raster-like manner, wherein said deflection yoke imparts a negative astigmatism in a beam deflection zone to the beams incident on the screen, giving rise to beam horizontal under-focusing, said CRT further including a high voltage lens portion including a dynamic electrostatic quadrupole for focusing the beams on the screen, a low voltage electron beam forming arrangement comprising:

a first charged electrode having a first plurality of inline through-hole circular apertures each aligned with a respective one of said cathodes and having an associated aligned rectangular indentation, wherein each of said rectangular indentations has a longitudinal axis oriented generally vertically, or transverse to the three inline cathodes; and a second charged electrode having a second plurality of inline through-hole circular apertures each aligned with a respective one of said first plurality of apertures in said first charged electrode, wherein each of said aligned first and second pluralities of through-hole circular apertures and said aligned rectangular indentation receives one of said three groups of energetic electrons and forms said energetic electrons into an electron beam and provides said electron beam to the high voltage lens portion of the CRT, wherein said rectangular indentations are disposed toward a first surface side of said first charged electrode, and wherein said first surface side is in facing relation to said second charged electrode;

wherein said electrodes apply a fixed negative astigmatism to each of the electron beams in a horizontal overfocusing of the electron beams to reduce the horizontal beam size in the deflection zone and improve the deflected electron beam's horizontal resolution, and wherein said first charged electrode is a $G_2$ screen electrode maintained at a first voltage $V_{F2}$ and said second charged electrode is a $G_1$ control electrode maintained at a second voltage $V_{F1}$.

22. The low voltage electron beam forming arrangement of claim 21 wherein $V_{F2}>V_{F1}$ and $G_1$ control electrode and said $G_2$ screen electrode comprise a static electrostatic quadrupole.

23. The low voltage electron beam forming arrangement of claim 22 wherein said $G_1$ control electrode is disposed intermediate said cathodes and said $G_2$ screen electrode.

24. The low voltage electron beam forming arrangement of claim 23 wherein said first plurality of inline circular apertures are disposed toward a first surface side of said $G_2$ screen electrode, and wherein said first surface side is in opposed relation to said $G_1$ control electrode.

25. The low voltage electron beam forming arrangement of claim 24 wherein said plurality of spaced rectangular indentations are disposed in a second opposed surface side of said $G_2$ screen electrode, and wherein each through-hole circular aperture is aligned with a respective one of said rectangular indentations for passing an electron beam.

26. For use in a color cathode ray tube having a display screen and a self-converging magnetic deflection yoke for deflecting a plurality of electron beams across said display screen, wherein said deflection yoke imposes a negative astigmatism on said electron beams resulting in horizontal under-focusing and vertical over-focusing of said electron beams when deflected toward a lateral edge of said display screen, an electron gun comprising:

a plurality of cathodes for providing a plurality of groups of energetic electrons;

low voltage beam forming means disposed adjacent said cathodes for receiving and forming each of said groups of electrons into a respective beam directed toward the display screen;

static electrostatic quadrupole means disposed in said beam forming means for applying a fixed negative astigmatism to each of the electron beams for over-focusing horizontally, thereby reducing a spot size of said each electron beam in a horizontal cross-section;

high voltage beam focusing means disposed intermediate said beam forming means and the display screen for focusing each of the electron beams on the display screen; and dynamic electrostatic quadrupole means disposed in said beam focusing means for applying a deflection dependent positive astigmatism to said each of the horizontally over-focusing electron beams when said electron beams are deflected toward a lateral edge of said display screen for compensating for the negative astigmatism of said self-converging magnetic deflection yoke and of said static electrostatic quadrupole means thereby reducing said electron beam horizontal spot size.

27. For use in a color cathode ray tube (CRT) including a plurality of cathodes for providing a plurality of groups of energetic electrons, low voltage beam forming means for receiving and forming each of said groups of energetic electrons into a respective electron beam, high voltage beam focusing means for receiving and focusing each of said electron beams, and a screen for receiving each of said electron beams and forming a spot image of each of said electron beams, wherein a self-converging magnetic deflection yoke deflects said electron beams across said display screen in a synchronous, raster-like manner and wherein said deflection yoke imposes a negative astigmatism on said electron beams resulting in a horizontal under-focusing, or elongation, and vertical over-focusing, or compression, of said electron beams when deflected toward a lateral edge of said display screen, an arrangement for improving an electron beam spot size on said display screen comprising:

static electrostatic quadrupole means disposed in said low voltage beam forming means for applying a fixed negative astigmatism to each of the electron beams thereby reducing a spot size of said each electron beam in a horizontal cross-section; and dynamic electrostatic quadrupole means disposed in said high voltage beam focusing means for applying a positive astigmatism to said each of the electron beams, wherein said positive astigmatism increases as said beams are deflected toward a lateral edge of said display screen with essentially no positive astigmatism applied when said electron beams are horizontally undeflected and wherein said positive astigmatism compensates for the negative astigmatism of said self-converging magnetic deflection yoke and of said static electrostatic quadrupole means for reducing said electron beam spot size on said display screen.

* * * * *

UNITED STATES PATENT AND TRADEMARK OFFICE

CERTIFICATE OF CORRECTION

PATENT NO. : 5,350,967

DATED : September 27, 1994

INVENTOR(S) : Hsing-Yao Chen

It is certified that error appears in the above-indentified patent and that said Letters Patent is hereby corrected as shown below:

Column 15, line 29, after "and", insert --said--.

Signed and Sealed this

Twenty-seventh Day of December, 1994

*Attest:*

Bruce Lehman

BRUCE LEHMAN

*Attesting Officer*

*Commissioner of Patents and Trademarks*